United States Patent [19]

Richardson

[11] Patent Number: 4,662,039

[45] Date of Patent: May 5, 1987

[54] GRIPPING DEVICE

[76] Inventor: Brian E. Richardson, 6100 Calle de Amor, San Jose, Calif. 95124

[21] Appl. No.: 743,006

[22] Filed: Jun. 10, 1985

[51] Int. Cl.[4] ..... A44B 21/00

[52] U.S. Cl. ..... 24/489; 24/346; 24/511; 24/562

[58] Field of Search ..... 24/489, 501, 511, 562, 24/564, 568, 335, 336, 338, 346; 223/91, 93

[56] References Cited

U.S. PATENT DOCUMENTS

| | | | |
|---|---|---|---|
| 1,149,444 | 8/1915 | Hodgson | 24/511 |
| 2,036,655 | 4/1936 | Storaasli | 24/338 |
| 2,499,517 | 3/1950 | Marini | 24/346 |
| 2,920,365 | 1/1960 | Colangelo | 24/489 |
| 3,084,368 | 4/1963 | Kolk | 24/562 |
| 3,135,034 | 6/1964 | Fauteux | 24/489 |
| 3,239,902 | 3/1966 | Cohen | 223/91 |
| 3,349,453 | 10/1967 | Chiyoichiida et al. | 24/346 |
| 3,756,550 | 9/1973 | Kollitz | 24/511 |
| 4,228,569 | 10/1980 | Snyder | 24/489 |
| 4,253,216 | 3/1981 | Brown | 24/335 |

FOREIGN PATENT DOCUMENTS

| | | | |
|---|---|---|---|
| 179385 | 5/1962 | Sweden | 24/501 |
| 898825 | 6/1962 | United Kingdom | 24/511 |

*Primary Examiner*—Victor N. Sakran
*Attorney, Agent, or Firm*—John J. Leavitt

[57] ABSTRACT

Presented is a gripping device incorporating a "live" and integral resilient blade for normally retaining the two elongated levers of the gripping device spaced apart at one end and in gripping relationship at the opposite end. The gripping device also incorporates an auxiliary holding device to which an element may be secured for relative rotation in relation to the gripping device.

5 Claims, 6 Drawing Figures

GRIPPING DEVICE

BACKGROUND OF THE INVENTION

1. Field of the Invention

This invention relates to gripping devices, and particularly to a gripping device which incorporates an integral resilient biasing element and an auxiliary holding device which may be attached to a separate structure apart from the structure to which the gripping device is attached.

2. Description of the Prior Art

It is believed that the prior art related to this invention may be found in Class 24, sub-classes 3R; 3K; 248R; 255SL; 81 and 137. Prior art may also reside in Class 132, sub-class 46.

A search for patents in these classes and sub-classes has revealed the existence of U.S. Pat. Nos. 2,454,723; 2,471,606; 2,920,365; 3,203,061; 3,357,438; 3,456,262; 4,145,793 and 4,277,863. Only U.S. Pat. Nos. 3,357,438 and 4,277,863 appear to have any pertinency in that they illustrate an integral resilient member to provide bias between opposed arms of the gripping devices, and a "live" hinge therebetween. However, these two patent structures are obviously different in their structure and mode of operation from the subject matter of the instant invention.

There are many uses for gripping devices, and the prior art listed above indicates some of the many different structures and modes of operation of the various devices. With the exception of U.S. Pat. Nos. 3,357,438 and 4,277,863, all the other patents listed above illustrate structures in which some type of metallic spring member is interposed between two superposed and hinged elongated lever members to form a gripping device from the elongated members. The two patents noted as exceptions eliminate such a resilient metallic third member and substitute a "live" hinge which functions as a hinge about which the elongated levers may pivot, and functions also as a resilient member to provide resilient bias between the two elongated members, thus performing a double function. It is one of the objects of the present invention to provide a gripping device incorporating two elongated lever members superposed in relation to each other and which eliminate the necessity of using a metallic spring-like element to impose bias between the two members.

Another object of the invention is to provide an integral "live" resilient blade which may be injection molded integrally with one of the elongated lever members to impose the requisite bias between the two levers, in association with a stirrup-like structure which forms a fulcrum to accommodate pivotal movement of one of the elongated lever members in relation to the other.

Most of the patents above that utilize a metallic spring-like member to impose bias between the two elongated clamping members are related in some way or other to clamping clothes to a clothes line. None of these prior patents appear to teach a gripping device utilizing an auxiliary holding member to which an object may be attached for rotation in relation to the gripping device. Accordingly, another object of the present invention is to provide a gripping device of the character described incorporating a rotatable holding member which may optionally be used to retain another object attached to the gripping device.

The invention possesses other objects and features of advantage, some of which, with the foregoing, will be apparent from the following description and the drawings. It is to be understood, however, that the invention is not limited to the embodiment illustrated and described, since it may be embodied in various forms within the scope of the appended claims.

SUMMARY OF THE INVENTION

In terms of broad inclusion, the gripping device of the invention comprises two superposed elongated lever members each having a jaw portion at one end, an intermediate body portions, and a handle portion at the opposite end remote from the jaw portion. Intermediate the ends of the two superposed elongated lever members is a stirrup adapted to embrace the intermediate body portion of one of the lever members in such a manner as to permit the lever member that is embraced to lie at an angle with the opposing lever member whereby when the jaw portions are related in a contiguous relationship, the handle portions of the two elongated lever members are spaced apart. Disposed between the two elongated lever members is an integral resiliently flexible blade secured by one of its ends to an end portion of one of the elongated lever members, while the opposite end of the resiliently flexible blade is slidably engageable with the opposing elongated lever member whereby when the handle portions of the elongated lever members are squeezed in a direction to reduce the space therebetween, the spring loading of the flexibly resilient blade is increased, the handle portions move toward each other, and the jaw portions of the gripping device move apart. A U-shaped auxiliary holder is rotatably mounted on one of the elongated lever members and is adapted to receive a cord or cable or wire therethrough whereby the cord, cable or wire is maintained in a selected orientation with respect to the gripping member, which itself is detachably secured to a supporting structure.

DESCRIPTION OF THE PREFERRED EMBODIMENT

Figure 1:
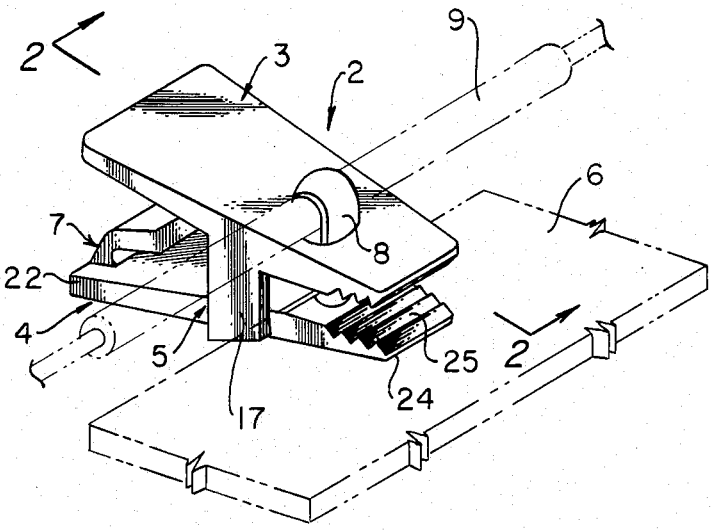
FIG. 1 is a perspective view illustrating the gripping device of the invention attached to a supporting structure, and illustrating an elongated cable retained by the auxiliary holding means.

In terms of greater detail, the gripping device of the invention is designated generally by the numeral 2, and includes a first elongated lever member 3, a second elongated lever member 4, the two elongated lever members lying in opposed juxtaposition, or superposition with the elongated lever member 3 being provided with an integral stirrup 5 embracing the second elongated lever member intermediate its ends to form a fulcrum for the second elongated lever member as will hereinafter be explained. Cooperating with the stirrup to retain the gripping device in gripping relationship to a supporting structure 6 is an integral flexibly resilient blade designated generally by the numeral 7 and interposed between the two elongated lever members as illustrated.

Referring to FIG. 1, it will be seen that the gripping device is provided with an auxiliary holding member 8 detachably mounted on the first elongated lever member and adapted to embrace and retain a structure such as a cable 9.

Figure 2:
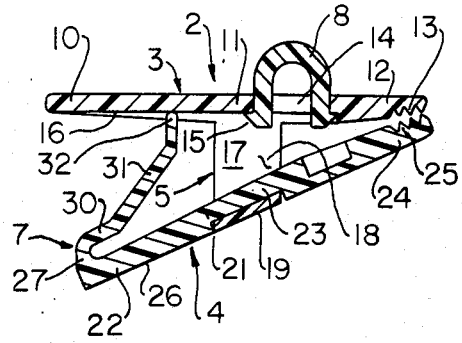
FIG. 2 is a vertical cross sectional view taken in the plane indicated by the line 2—2 of FIG. 1.
Figure 5:
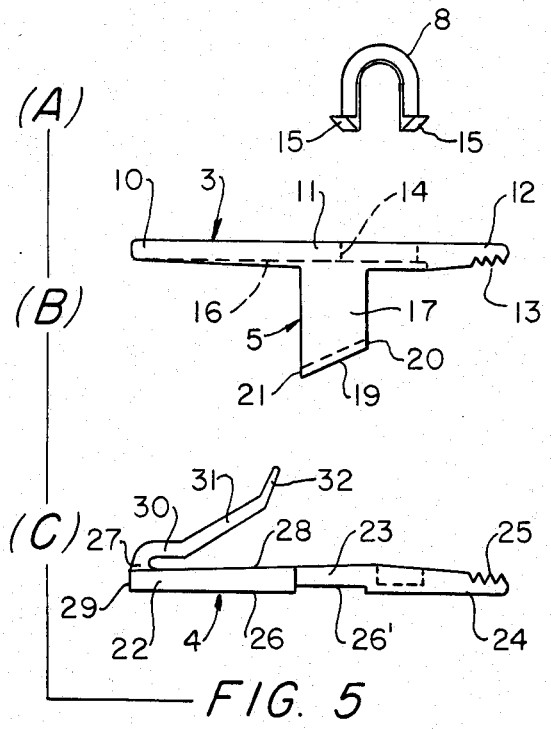
FIG. 5 is a side elevational composite view illustrating the gripping device assembly incorporating an auxiliary holding device.
Figure 6:
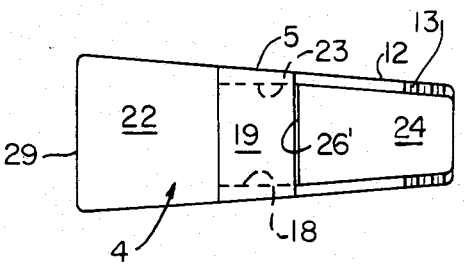
FIG. 6 is a bottom plan view taken in the direction of the arrow 6 illustrated in FIG. 4 and showing the bottom side of the stirrup which embraces and forms a fulcrum for the lower elongated lever member.

As illustrated in FIGS. 2 and 5, the first elongated lever member 3 comprises a handle portion 10, an intermediate body portion 11, and a jaw portion 12 having appropriate teeth 13 for gripping an object that might be placed between the jaw portions of the two elongated lever members. The elongated lever member, specifically the intermediate body portion 11 thereof, is provided with an aperture 14 through which extends the generally U-shaped auxiliary holding member 8, the arms of the U-shaped auxiliary holding member extending through the aperture 14 and being provided with laterally extending shoulders 15 that engage the undersurface 16 of the elongated lever member in the immediate area surrounding the aperture 14.

The first elongated lever member 3 is also provided with the integral stirrup 5 which constitutes a generally U-shaped structure the arms 17 and 18 of which are integrally dependent from opposite side edge portions of the lever to be joined integrally by a transversally extending fulcrum plate 19. The fulcrum plate possesses a front edge 20 spaced a predetermined distance from the lever 3, and a rear edge 21 spaced farther from the lever 3 than front edge 20, so that the fulcrum plate lies angularly disposed to the lever 3 at an angle of approximately 30°. The stirrup 5 thus provides a generally U-shaped structure having an opening through which extends the second elongated lever 4, to be embraced by the side arms 17 and 18 and fulcrum plate 19.

Figure 3:
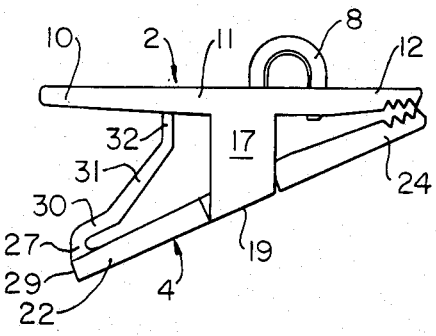
FIG. 3 is a side elevational view of the gripping device with the auxiliary holding means in place.

The second elongated lever member 4, like lever 3, is constituted of a handle portion 22, an intermediate body portion 23 and a jaw portion 24 having gripping teeth 25 formed therein to cooperate with the gripping teeth 13 formed in lever 3. As illustrated in FIGS. 2 and 5, the lower surface 26 of the lever 4 is formed with a notch 26' in its intermediate body 23 dimensioned to snugly receive in complimentary fashion the fulcrum plate 19 when the jaw portions 12 and 24 are contiguous as illusrated. The jaw portions are resiliently retained in the position illustrated in FIGS. 2 and 3 by a biasing force interposed between the two lever arms.

The handle portions 10 and 22 of levers 3 and 4, respectively, are biased away from each other into their spaced relationship by the integral resiliently flexible blade 7. The blade 7 includes a root portion 27 integral with the upper surface 28 of the lever 4 adjacent its end edge 29. The root portion extends away from surface 28 substantially perpendicularly thereto, and merges smoothly and integrally with blade portion 30 which extends toward the jaw portion and lies substantially parallel to lever 4. At a point spaced from the root portion, the parallel blade portion 30 merges smoothly and integrally with an angularly disposed blade portion 31 that extends away from the lever 4 at an angle of approximately 30°. The angularly disposed blade portion 31 merges smoothly and integrally with terminal end portion 32 which slidably abuts the lower surface 16 of lever 3, as illustrated, adjacent the intermediate body portion of the lever 3.

Figure 4:
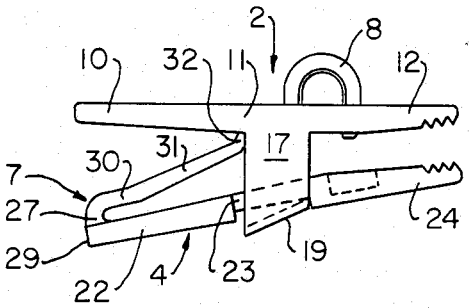
FIG. 4 is a side elevational view of the gripping device shown with the handle portions of the elongated lever members partially depressed to pivot the jaw portions into open or separated relationship.

It will thus be seen that as pressure is applied on the handle portions 10 and 22 in a direction to reduce the space therebetween, the notch 26' and front edge 20 of the stirrup plate 19 cooperate to form a fulcrum about which lever 4 may pivot. As pivotal action takes place, the jaw portions 12 and 24 separate while handle portions 10 and 22 move toward each other. As handle portions 10 and 22 move toward each other, the terminal end portion 32 of the resiliently flexible blade 7 slides toward the associated intermediate body portion 11 of lever 3, thus causing the resiliently flexible blade to flex toward the second elongated lever member 4 as illustrated in FIG. 4. The proportions and dimensions of the parts are such that when the handle portions have been moved as close together as possible to provide separation of the jaw portions to their widest extent, the resiliently flexible blade 7 lies substantially parallel to the second elongated lever member, and exerts a maximum biasing force on the lever arms 3 and 4, tending to separate the handle portions and close the jaw portions.

Thus, while the gripping device resiliently grips a supporting structure 6 as illustrated in FIG. 1, the cable or wire 9, retained by the auxiliary holding means 8, may slide longitudinally through the holder 8, and may also rotate 360° with the holder about an axis coincident with the center of circular aperture 14. It will of course be apparent that the use of the holding means 8 is optional, and that the holding means may be removed without affecting the operation of the remainder of the assembly as a gripping device.

Having thus described the invention, what is thought to be new and novel and sought to be protected by Letters Patent of the United States is as follows.

I claim:

1. A gripping device for detachable attachment to a supporting structure, comprising:

(a) a first elongated lever member having a jaw portion, a handle portion, and a body portion intermediate the jaw and handle portions and integral therewith;

(b) a second elongated lever member having a jaw portion, a handle portion, and a body portion intermediate the jaw and handle portions and integral therewith;

(c) a stirrup attached to said first elongated lever member and embracing the body portion of said second elongated lever member whereby said first and second elongated lever members are retained in corresponding juxtaposed overlying relationship; and (d) resilient means disposed between said first and second elongated lever members biasing said jaw portions into gripping relationship and said handle portions into spaced relationship;

(e) said first elongated lever member tapering from said handle portion to said jaw portion and possessing a top surface and a bottom surface, said stirrup being attached to said bottom surface and extending away therefrom to define a substantially U-shape the side arms of which are spaced and attached perpendicularly to said first elongated lever member while the bottom of said U-shape integrally connects the ends of said side arms remote from said first lever member, said bottom of said stirrup having a front edge adjacent said jaw portion and a rear edge adjacent said handle portion, said rear edge of said stirrup bottom being spaced from said lever member a greater distance than said front edge, whereby when said second elongated lever member is embraced by said stirrup said second elongated lever member is retained angularly disposed to said first elongated lever member and said front edge of said stirrup bottom functions as a fulcrum about which said second elongated lever member may pivot when pressure is applied on said handle portions to reduce the space therebetween resulting in said jaw portions being opened into a non-gripping relationship.

2. A gripping device for detachable attachment to a supporting structure, comprising:

(a) a first elongated lever member having a jaw portion, a handle portion, and a body portion intermediate the jaw and handle portions and integral therewith;

(b) a second elongated lever member having a jaw portion, a handle portion, and a body portion intermediate the jaw and handle portions and integral therewith;

(c) a stirrup attached to said first elongated lever member and embracing the body portion of said second elongated lever member whereby said first and second elongated lever members are retained in corresponding juxtaposed overlying relationship; and (d) resilient means disposed between said first and second elongated lever members biasing said jaw portions into gripping relationship and said handle portions into spaced relationship;

(e) said second elongated lever member tapering from said handle portion to said jaw portion and possessing a top surface and a bottom surface, the top surface of said second elongated lever member facing said first elongated lever member when said second elongated lever member is embraced by said stirrup, said second elongated lever member having a notch in the bottom surface thereof engaged by said stirrup, whereby relative axial displacement of said first and second elongated lever members is prevented when pressure on said handle portions is applied in a direction to reduce the space therebetween.

3. A gripping device for detachable attachment to a supporting structure, comprising:

(a) a first elongated lever member having a jaw portion, a handle portion, and a body portion intermediate the jaw and handle portions and integral therewith;

(b) a second elongated lever member having a jaw portion, a handle portion, and a body portion intermediate the jaw and handle portions and integral therewith;

(c) a stirrup attached to said first elongated lever member and embracing the body portion of said second elongated lever member whereby said first and second elongated lever members are retained in corresponding juxaposed overlying relationship;

(d) resilient means disposed between said first and second elongated lever members biasing said jaw portions into gripping relationship and said handle portions into spaced relationship; and (e) auxiliary holding means mounted on said first elongated lever member;

(f) said first elongated lever member being provided with an aperture associated with said body portion, and said auxiliary holding means comprises a U-shaped member extending through said aperture whereby the bottom of said U-shaped member lies on one side of the first elongated lever member and the ends of the arms of the U-shaped member lie on the opposite side of the first elongated lever member, and means are provided on said ends of the arms of said U-shaped member engaging said first elongated lever member and preventing passage in one direction of said U-shaped member through said aperture of said first elongated lever member.

4. A gripping device for detachable attachment to supporting structure, comprising:

(a) a first elongated lever member having a jaw portion, a handle portion, and a body portion intermediate the jaw and handle portions and integral therewith;

(b) a second elongated lever member having a jaw portion, a handle portion, and a body portion intermediate the jaw and handle portions and integral therewith;

(c) a stirrup attached to said first elongated lever member and embracing the body portion of said second elongated lever member whereby said first and second elongated lever members are retained in corresponding juxtaposed overlying relationship; and (d) resilient means disposed between said first and second elongated lever members biasing said jaw portions into gripping relationship and said handle portions into spaced relationship;

(e) said resilient means comprising a resiliently flexible blade one end of which is immovably secured to said second elongated lever member adjacent the end thereof associated with said handle portion and the other end of the blade slidably engages the first elongated lever member adjacent said intermediate body portion whereby pressure on said handle portions applied in a direction to reduce the space therebetween results in resilient flexing of said resiliently flexible blade;

(f) said resilient flexible blade being provided with a root portion integral with said second elongated lever member adjacent the end thereof associated with the handle portion thereof, said root portion merging smoothly and integrally with a first resilient blade portion lying parallel with and spaced from said second elongated lever member and extending therealong for a predetermined distance, said first resilient blade portion merging smoothly and integrally with a second resilient blade portion which extends angularly away from said first resilient blade portion toward said first elongated lever, and a third resilient blade portion integral with said second resilient blade portion and constituting an integral extension thereof angularly disposed to said second resilient blade portion and lying substantially perpendicular to said first elongated lever adjacent said body portion thereof, whereby when pressure is applied on said handle portions of said first and second elongated levers in a direction to diminish the space therebetween, said third resilient blade portion is caused to slide along the first elongated lever member toward said jaw portion thereof and said second resilient blade portion is caused to flex resiliently into a near-parallel relationship with said second elongated lever member when said handle portions are squeezed together to open said jaw portions.

5. The combination according to claim 1, 2 or 4, in which auxiliary holding means are rotatably mounted on said first elongated lever member.

* * * * *